US005775374A

United States Patent [19]

Doi et al.

[11] Patent Number: 5,775,374

[45] Date of Patent: Jul. 7, 1998

[54] SOLENOID CONTROLLED VALVE

[75] Inventors: Takashi Doi, Kodaira; Naoki Homma, Hoya; Shinichiro Hamada, Adachi, all of Japan

[73] Assignee: Koganei Corporation, Tokyo, Japan

[21] Appl. No.: 369,716

[22] Filed: Jan. 6, 1995

[30] Foreign Application Priority Data

Jan. 6, 1994 [JP] Japan ..... 6-000266
Jan. 17, 1994 [JP] Japan ..... 6-003216

[51] Int. Cl.[6] ..... F15B 13/043

[52] U.S. Cl. ..... 137/625.64; 137/269; 137/270

[58] Field of Search ..... 137/269, 270, 137/625.64

[56] References Cited

U.S. PATENT DOCUMENTS 5,437,306 8/1995 Asou et al. ..... 137/625.64

*Primary Examiner*—Gerald A. Michalsky
*Attorney, Agent, or Firm*—McCormick, Paulding & Huber

[57] ABSTRACT

A small diameter piston is provided at one end of a valve shaft having a plurality of the valves, a large diameter piston is provided at the other, the valve shaft is moved by the acting of pilot pressure. A first operated passage communicating with a large diameter pressure chamber is opened and blocked by a first solenoid, a second operated passage communicating with a small diameter pressure chamber is opened and blocked by a first solenoid. A by-pass for communicating between an intake port and the small diameter pressure chamber is formed. A fluid passage changing block is provided at the outside of the small diameter piston of a housing. A by-pass communicating hole and a communicating hole for a second operated passage are opened at the fluid passage changing block in order to convert the initial position and the actuated position. The valve shaft is operated by the operation of the first solenoid with communicating between the by-pass and the small diameter pressure chamber at the initial position. The valve shaft is operated by the operation of the first solenoid and the second solenoid with communicating between the second operated passage and the small diameter pressure chamber at the actuated position.

2 Claims, 12 Drawing Sheets

SOLENOID CONTROLLED VALVE

BACKGROUND OF THE INVENTION

1. Field of the Invention

This invention relates to a solenoid controlled valve which is operated by an electromagnet and controls the starting, the stopping and the direction of movement of an actuator.

2. Description of the Related Art

In a controllable valve for controlling the starting, the stopping and the direction of movement of an actuator, as a solenoid controlled valve operated by an electro-magnet, a single solenoid controlled valve operated by one solenoid, and a double solenoid controlled valve operated by two solenoids are proposed.

A single solenoid controlled valve has a construction in which the valve shaft returns to the normal position when the energizing of the solenoid is stopped in an electro-magnet, that is to say, "a return position type". On the other hand, a double solenoid controlled valve has a construction in which the valve shaft holds the position when the solenoid is energized, that is to say, "a hold position type". Thus the valve shaft of a single solenoid controlled valve returns to the normal position when the energizing to the solenoid is turned off, the valve shaft of a double solenoid controlled valve holds the position before the solenoid is energized.

Recently, a manifold solenoid controlled valve in which a plurality of solenoid controlled valves is attached to one manifold block has been invented. The manifold solenoid controlled valve, in which an intake manifold and an exhaust manifold are formed in the manifold block, charges the intake port and discharges the exhaust port to a plurality of solenoid controlled valves through the manifold block.

In the case of a solenoid controlled valve being used in a parts assembling factory, corresponding with a kind of actuator, a control method and the like, a single solenoid controlled valve or a double solenoid controlled valve is selected. When an actuator, a control method and the like are converted, a single solenoid controlled valve which is a "return position type" is converted to a double solenoid controlled valve which is a "hold position type".

In this case, any solenoid controlled valve of a plurality of solenoid controlled valves must be removed and converted to the other type of solenoid controlled valve. However, it is not easy to convert the solenoid controlled valve, as stopping the production line in the factory is necessary, so that productivity is not high.

SUMMARY OF THE INVENTION

It is an object of the invention to provide a solenoid controlled valve which can easily convert to a "return position type" or a "hold position type" without being changed.

So as to satisfy this object, the present invention provides a solenoid controlled valve wherein a valve hole formed in a housing;

a valve shaft fitted in the valve hole slidably to the axial direction thereof, which has a large diameter piston at one end portion thereof and a small diameter piston at the other end portion thereof, which is provided with a plurality of valves;

an intake port opened at the valve hole; and a plurality of output ports and an exhaust port(s) communicating with the intake port, which are formed in the housing;

the solenoid controlled valve comprising:

(1) a first solenoid, which opens and blocks a first operated passage communicating between a common communicating passage communicated with the intake port and a large diameter pressure chamber housing the large diameter piston;

(2) a second solenoid, which opens and blocks a second operated passage communicating between a small diameter pressure chamber housing the small diameter piston and the intake port;

(3) a by-pass, which communicates between the intake port and the small diameter pressure chamber; and (4) a converting means, which converts to an initial position or an actuated position;

at the initial position, the valve shaft is actuated by the first solenoid in the state to make the by-pass and the small diameter pressure chamber communicate with each other;

at the actuated position, the valve shaft is actuated by the first solenoid and the second solenoid in the state to block the communication between the by-pass and the small diameter pressure chamber.

Further, it is also possible to comprise:

(1) a first solenoid, which opens and blocks a first operated passage communicating between a common communicating passage communicated with the intake port and a large diameter pressure chamber housing the large diameter piston;

(2) a second solenoid, which opens and blocks a second operated passage communicating between a small diameter pressure chamber housing the small diameter piston and the intake port;

(3) a by-pass, which communicates with the small diameter pressure chamber through the second operated passage, which communicates between the intake port and the small diameter pressure chamber; and (4) a converting means, which converts to an initial position or an actuated position;

at the initial position, the valve shaft is actuated by the first solenoid in the state to make the by-pass and the small diameter pressure chamber communicate with each other;

at the actuated position, the valve shaft is actuated by the first solenoid and the second solenoid in the state to block the communication between the by-pass and the small diameter pressure chamber.

Furthermore, it is also possible to comprise:

(1) a first solenoid, which opens and blocks a first operated passage communicating between a common communicating passage communicated with the intake port and a large diameter pressure chamber housing the large diameter piston;

(2) a second solenoid, which opens and blocks a second operated passage communicating between a small diameter pressure chamber housing the small diameter piston and the intake port;

(3) a by-pass, which is formed parallel to the second operated passage, which communicates between the intake port and the small diameter pressure chamber; and (4) a converting means, which converts to an initial position or an actuated position;

at the initial position, the valve shaft is actuated by the first solenoid in the state to make the by-pass and the small diameter pressure chamber communicate with each other and in the state to block the communication between the second operated passage and the small diameter pressure chamber simultaneously;

at the actuated position, the valve shaft is actuated by the first solenoid and the second solenoid in the state to make the second operated passage and the small diameter pressure chamber communicate with each other and in the state to block the communication between the by-pass and the small diameter pressure chamber simultaneously.

The solenoid controlled valve constructed as above: is predetermined to a "single solenoid type" when the position of the converting means is set so as to drive the first solenoid; and is predetermined to a "double solenoid type" when the position of the converting means is set so as to drive both solenoids. It is therefore possible to easily convert the type of solenoid controlled valve in a short time without changing.

DESCRIPTION OF THE PREFERRED EMBODIMENTS (First Embodiment)

Hereinafter a solenoid controlled valve in accordance with the first embodiment of the present invention is described in detail with referencing Figures.

A charging port 2 and two exhaust ports 3,4 are formed in a manifold block 1. A plurality of solenoid controlled valves 5*a*–5*c* are mounted on the manifold block 1. Further, output ports 6*a*14 6*c*,7*a*–7*c* corresponding to the solenoid controlled valves 5*a*–5*c*, are formed in the manifold block 1, the fluid is discharged from the output ports 6*a*14 6*c* or the output ports 7*a*–7*c* in accordance with the actuation of the solenoid controlled valve 5*a*–5*c*.

Pneumatic cylinders 8*a*,8*b* as actuator are connected to the output ports 6*a*,6*b* and the output ports 7*a*,7*b*. Rods 8*a*,9*b* of the pneumatic cylinders 8*a*,8*b* corresponding to the solenoid controlled valves 5*a*,5*b* are respectively driven by operating the solenoid controlled valves 5*a*,5*b*.

Figure 2:
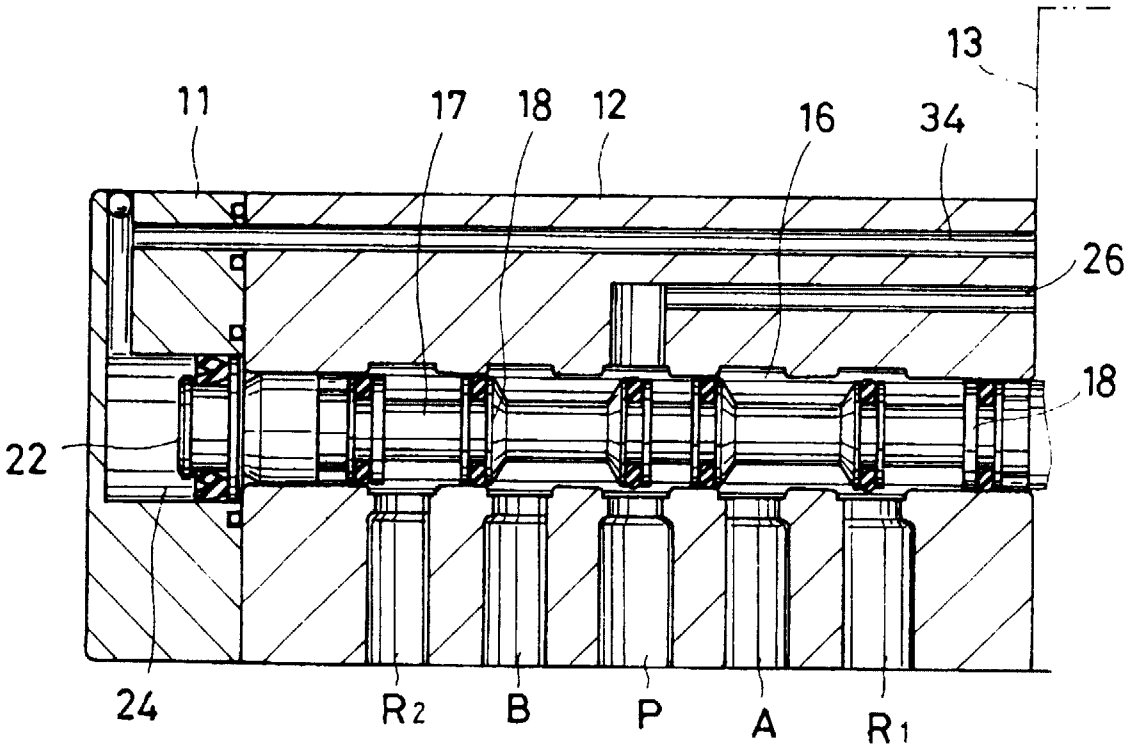
FIG. 2 is a sectional view showing an approximately half part of the solenoid controlled valve.
Figure 3:
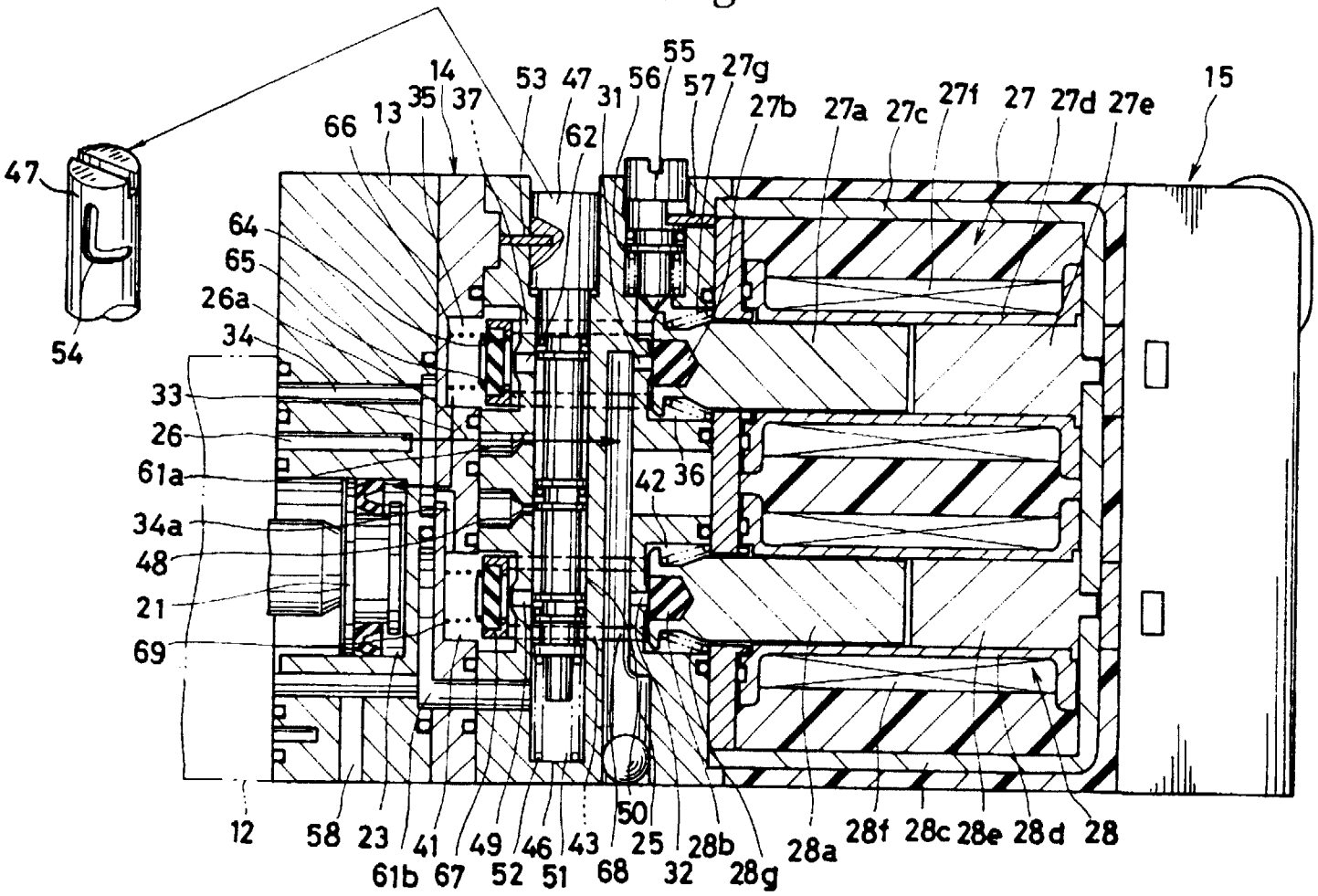
FIG. 3 is a sectional view showing the other part of the solenoid controlled valve which is set to a single solenoid type.

As shown in FIG. 2, the solenoid controlled valve is provided with a pilot portion 11 and a main valve portion 12, the pilot portion 11 and the main valve portion 12 are unitarily formed. As shown in FIG. 3, the main valve portion 12 is unitarily formed into a pilot portion 13, a selector part 14 and a solenoid valve hole 16 (FIG. 2). The housing of the solenoid controlled valve is thereby constituted. The housing, at the lower portion thereof, is fixed on a manifold block not shown in the Figure.

A valve hole 16 is, as shown in FIG. 2, formed in the main valve portion 12. Further, a charging port (P) opened to the valve hole 16 is formed at the center portion in the axial direction of the main valve portion 12. Furthermore, an exhaust port ($R_1$) and an exhaust port ($R_2$) are formed at both end portions of the main valve portion 12 with openings to the valve hole 16. The charging port (P) communicates with the charging port 2 of the manifold block 1. The exhaust port ($R_1$) communicates with the exhaust port 3, the exhaust port ($R_2$) communicates with the exhaust port 4. An output port (A) is formed between the charging port (P) and the exhaust port ($R_1$), which is opened to the valve hole 16. An output port (B) is formed between the charging port (P) and the exhaust port ($R_2$), which is opened to the valve hole 16. The output port (A) communicates with the output ports 6*a* of the manifold block 1, the output port (B) communicates with the output ports 7*a* of the manifold block 1.

A valve shaft 17 is fitted into the valve hole 16 slidably in the axial direction thereof. In the first embodiment, six valves 18 are attached on the valve shaft 17. Thus, as shown in FIG. 2, the valve shaft 17 is in the state to move to the right in FIG. 2, the charging port (P) and the output port (B) communicate with each other, and the output port (A) and the exhaust port ($R_2$) communicate with each other. The valve shaft 17 is in the state to move to the left in FIG. 2, the charging port (P) and the output port (A) communicate with each other, the output port (B) and exhaust port ($R_2$) communicate with each other.

As shown in FIG. 3, a large diameter piston 21 is provided at one end of the valve shaft 17, that is, the right end of the valve shaft 17. A small diameter piston 22 is provided at the other end of the valve shaft 17, the diameter of which is smaller than that of the large diameter piston 21. In the Figure, the pressed area of the large diameter piston 21 is predetermined to be twice the pressed area of the small diameter piston 22. The large diameter piston 21 is housed in a large diameter pressure chamber 23 which is formed in the pilot portion 13, the small diameter piston 22 is housed in a small diameter pressure chamber 24 which is forced into the pilot portion 11.

As shown in FIG. 3, a common communicating passage 25 is formed in the selector part 14, which communicates to the charging port (P) by the communicating passage 26. Thus, the fluid is ordinarily supplied to the common communicating passage 25 from the charging port (P). A symbol 26*a* indicates a communicating pass which is formed at the selector part 14. The communicating passage 26*a* is for connecting between the part (formed at the pilot portion 13 of the communicating passage 26) and the common communicating passage 25. The communicating passage 26*a* is formed at the position which departs from the cross section shown in FIG. 3.

The first communicating port 31 formed at the common communicating passage 25 communicates with the large diameter pressure chamber 23 through the first operated passage 33 (indicated by an arrow in FIG. 3). Further, the plunger 27*a* for opening and blocking the first operated passage 33, provided at the first solenoid 27, faces the first communicating port 31.

A second communicating port 32 formed at the common communicating passage 25 communicates with the small diameter pressure chamber 24 through a second operated passage 34. Further, a plunger 28*a* for opening and blocking the second operated passage 34, provided at the second solenoid 28, faced the second communicating port 32.

A valve 27*b* for press fitting to the first communicating port 31 is provided at the top end portion of a plunger 27*a* of the first solenoid 27, the plunger 27*a* is attached in a bobbin 27*d* fitted to a yoke 27*c* slidably in the axial direction thereof A fixed core 27*e* is fixed at the back end portion of a bobbin 27*d*, a solenoid is formed by winding a coil 27*f*.

The plunger 27*a* is energized by a pressed coil spring 27*g* so that the valve 27*b* might be press fitted to the first communicating port 31. When the coil 27*f* is energized, the plunger 27*a* is separated from the first communicating port 31 in resistance to the press force.

The second solenoid 28 is provided at the position of the solenoid 15, adjacent to the first solenoid 27, parallel thereto, which is the same construction as the first solenoid 27. The constituting members of the second solenoid 28 are affixed the symbols "a"–"g" as well as are the constituting members of the first solenoid 27.

A fluid chamber 35 is formed at the selector part 14 on the prolongation line of the plunger 27*a*, which communicates with a fluid chamber 36 by a communicating hole 37, the fluid chamber 36 is formed at the outside of the top end portion of the plunger 27*a*. Thus, when the valve 27*b* is separated from the first communicating port 31 by energizing the coil 27*f*, at that time, the fluid in the common communicating passage 25 is supplied to the large diameter pressure chamber 23 through the fluid chamber 36 constituting a part of the first operated passage 33, the communicating hole 37 and the fluid chamber 35.

A fluid chamber 41 is formed at the selector part 14 on the prolongation line of the plunger 28*a*, which communicates with a fluid chamber 42 by a communicating port 43, the fluid chamber 42 is formed at the outside of the top end portion of the plunger 28*a*. Further, the fluid chamber 41 communicates with the second operated passage 34 by the passage 34*a*, the passage 34*a* constitutes a part of the second operated passage 34. Thus, when the 28*b* is separated from the second communicating port 32 by energizing the coil 28*f*, at that time, the fluid in the common communicating passage 25 is supplied to the small diameter pressure chamber 24 through the fluid chamber 42 constituting the second operated passage 34, the communicating port 43, the fluid chamber 41 and the passage 34*a*.

A spool shaft hole 46 is formed in the selector part 14 facing perpendicular to the valve hole 16, in which a convert-valve shaft (converting means) 47 is fitted slidably in the axial direction thereof. A supplying port 48 is formed, communicating with the common communicating passage 25 of the selector part 14 communicating with the charging port (P). The supplying port 48 is opened onto the spool shaft hole 46. Further, a communicating port 49 communicating with the spool shaft hole 46 and the fluid chamber 41 is formed at the selector part 14; an introducing port 62 communicating with the spool shaft hole 46 and the fluid chamber 35 is formed at the selector part 14.

The spool shaft hole 46 is provided with a by-pass 50. The by-pass 50 communicates between the charging port (P) and the small diameter pressure chamber 24 by making the supplying port 48 and the communicating port 49 communicate with each other, through the common communicating passage 25, the fluid chambers 41,42 and the second operated passage 34. The second operated passage 34 and the by-pass 50 communicate with the small diameter pressure chamber 24.

An exhaust opening 58 is formed at the pilot portion 13, which is opened to the outside-exterior, an exhaust passage 61*a* and exhaust passage 61*b* are respectively formed communicating with the exhaust opening 58.

An interlock pin 65 is passed through the communicating hole 37 between the plunger 27*a* and a valve member 64 integrated into the fluid chamber 35. A gap communicating with the fluid chamber 35 and the fluid chamber 36 is formed between the interlock pin 65 and the inside face of the communicating hole 37. Therefore, when the valve 27*b* of the first solenoid 27 is separated from the first communicating port 31, the introducing port 62 is blocked by the valve member 64 due to the press force of the spring 66.

An interlock pin 68 is passed through the communicating port 43 between the plunger bobbin 27*d* and a valve member 67 integrated into the fluid chamber 41. A gap communicating with the fluid chamber 41 and the fluid chamber 42 is formed between the interlock pin 68 and the inside face of the communicating port 43. Therefore, when the 28*b* of the second solenoid 28 is separated from the second communicating port 32, the communicating port 49 is blocked by the valve member 67 due to the press force of the spring 69.

As shown in FIG. 3, when the convert-valve shaft 47 is made to move forward in resistance to the press force of a pressed coil spring 52 provided in the spool shaft hole 46, the exhaust passage 61*b* and the communicating port 49 are blocked, and the supplying port 48 and the communicating port 49 are in a state to communicate with each other, the convert-valve shaft 47 is therefore at the initial position for the by-pass between the charging port (P) and the small diameter pressure chamber 24.

Figure 4:
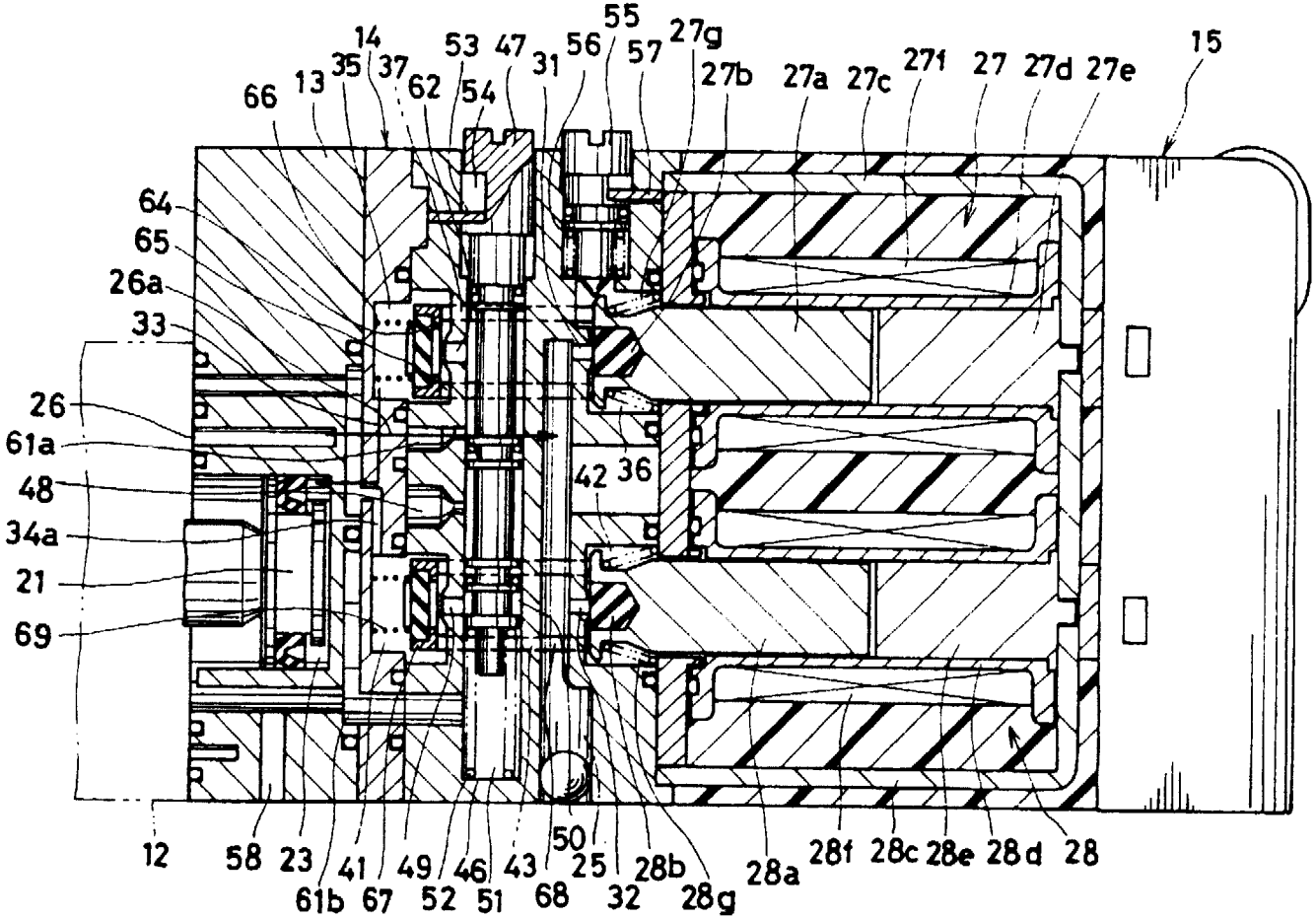
FIG. 4 is a sectional view showing the other part of the solenoid controlled valve which is set to a double solenoid type.

As shown in FIG. 4, when the convert-valve shaft 47 is made to move backward, the communication between the supplying port 48 and the communicating port 49 is released, the convert-valve shaft 47 is at the actuated position for blocking the by-pass 50. In the actuated position, when the coil 27*f* of the first solenoid 27 is energized, the fluid is supplied into the large diameter pressure chamber 23 by opening the first operated passage 33, so that the valve shaft 17 is moved from the position shown in FIG. 2 to the left therein. When the coil 28*f* of the second solenoid 28 is energized, the fluid is supplied into the small diameter pressure chamber 24 by releasing the second operated passage 34, so that the valve shaft 17 is at the position shown in FIG. 2. In the case in which the energizing to the coils 27*f*,28*f* is stopped, the position of the valve shaft 17 at that time is held.

A stopper pin 53 is provided at the selector part 14, for fixing the convert-valve shaft 47 at the forward position shown in FIG. 3 or the backward position shown in FIG. 4. A cam groove 54 is formed at the convert-valve shaft 47, which is a letter-L shape. The stopper pin 53 is engaged to the cam groove 54. Accordingly, when the convert-valve shaft 47 is made to rotate 90° from the position shown in FIG. 4, the convert-valve shaft 47 is moved backward to the initial position as shown in FIG. 3.

When the convert-valve shaft 47 is positioned to the initial position as shown in FIG. 3, the fluid in the charging port (P) is in a state to be supplied to the small diameter pressure chamber 24 through the by-pass 50 which is constituted by the spool shaft hole 46. The valve shaft 17 is therefore at the position shown in FIG. 2. In this state, when the coil **27*f* of the first solenoid 27 is energized, the valve shaft 17 is moved to the left in FIG. 2. When the energizing of the first solenoid 27 is stopped, the valve shaft 17** is made to return to the prior position.

A manual operation rod 55 is provided at the selector part 14 in order that the plunger **27*a* of the first solenoid 27 can be moved backward by a manual operation. The manual operation rod 55 is energized backward by the spring 56, the backward movement of which is controlled by a stopper 57**.

Next, the actuation of the solenoid controlled valve as in the above is described. FIG. 3 is a view showing the solenoid controlled valve employed as a single solenoid type. The coil **28*f* of the second solenoid 28 is not energized, and is predetermined to the stopped state. The convert-valve shaft 47 is set to the initial position shown in FIG. 3. In this case, the fluid is supplied into the small diameter pressure chamber 24 through the common communicating passage 25 constituting the by-pass 50, the supplying port 48, the communicating port 49, the fluid chamber 41 and the second operated passage 34. Hence, in the state in which the coil 27*f* of the first solenoid 27 is not energized, the valve shaft 17 is at the position shown in FIG. 2; because of the fluid pressure supplied to the small diameter pressure chamber 24**; the fluid of the charging port (P) flows out to the output port (B).

On the other hand, when the coil **27*f* of the first solenoid 27 is energized, the valve 27*b* separates from the first communicating port 31; the common communicating passage 25 and the fluid chambers 35,36 are in communicating state. Thus, the fluid flows out to the large diameter pressure chamber 23 from the charging port (P) through first operated passage 34. The pressed area of the large diameter piston 21 is predetermined to be twice as large as that of the small diameter piston 22, so that even when the fluid is supplied to the small diameter pressure chamber 24, the valve shaft 17 is moved to the left in FIG. 2 by the fluid supplied to the large diameter pressure chamber 23**. Hereby, the fluid of the charging port (P) flows to the output port (A), and the fluid from the output port (B) flows to the exhaust port ($R_2$).

Next, in the case in which the solenoid controlled valve is employed as a double solenoid type, the convert-valve shaft 47 is set to the actuated position shown in FIG. 4, the by-pass 50 is hereby blocked, and the coil **28*f* of the second solenoid 28** is predetermined to be in the state in which the electricity can be supplied thereto.

In this state, when the electricity is supplied to the coil **28*f* of the second solenoid 28, the fluid is supplied into the small diameter pressure chamber 24 through the second operated passage 34, the valve shaft 17 is at the position shown in FIG. 2 due to the fluid pressure. On the other hand, the energizing to the coil 28*f* of the second solenoid 28 is stopped, and when the coil 27*f* of the first solenoid 27 is energized, the fluid is supplied into the large diameter piston 23, the valve shaft 17 is hereby moved to the left of the position shown in FIG. 2. In this case, the valve shaft 17** holds the position even when the energizing is stopped.

In this way, the position of the convert-valve shaft 47 is changed to the initial position or the actuated position, and one solenoid controlled valve can be thereby employed as a single solenoid controlled valve (a "return position type") or a double solenoid controlled valve (a "hold position type").

Therefore, even in the case in which the solenoid controlled valve as above is employed on the production line in the factory, it is unnecessary to change the solenoid controlled valve, it is easy to convert the type of solenoid controlled valve, a "return position type" or a "hold position type", only by operating the convert-valve shaft 47. Consequently, even in the case in which the way of an assembling apparatus and the like is converted in a producing line such as an assembling line, or an working line, it is possible to correspond the conversion, productivity is therefore sharply improved.

(Second Embodiment)

Figure 5:
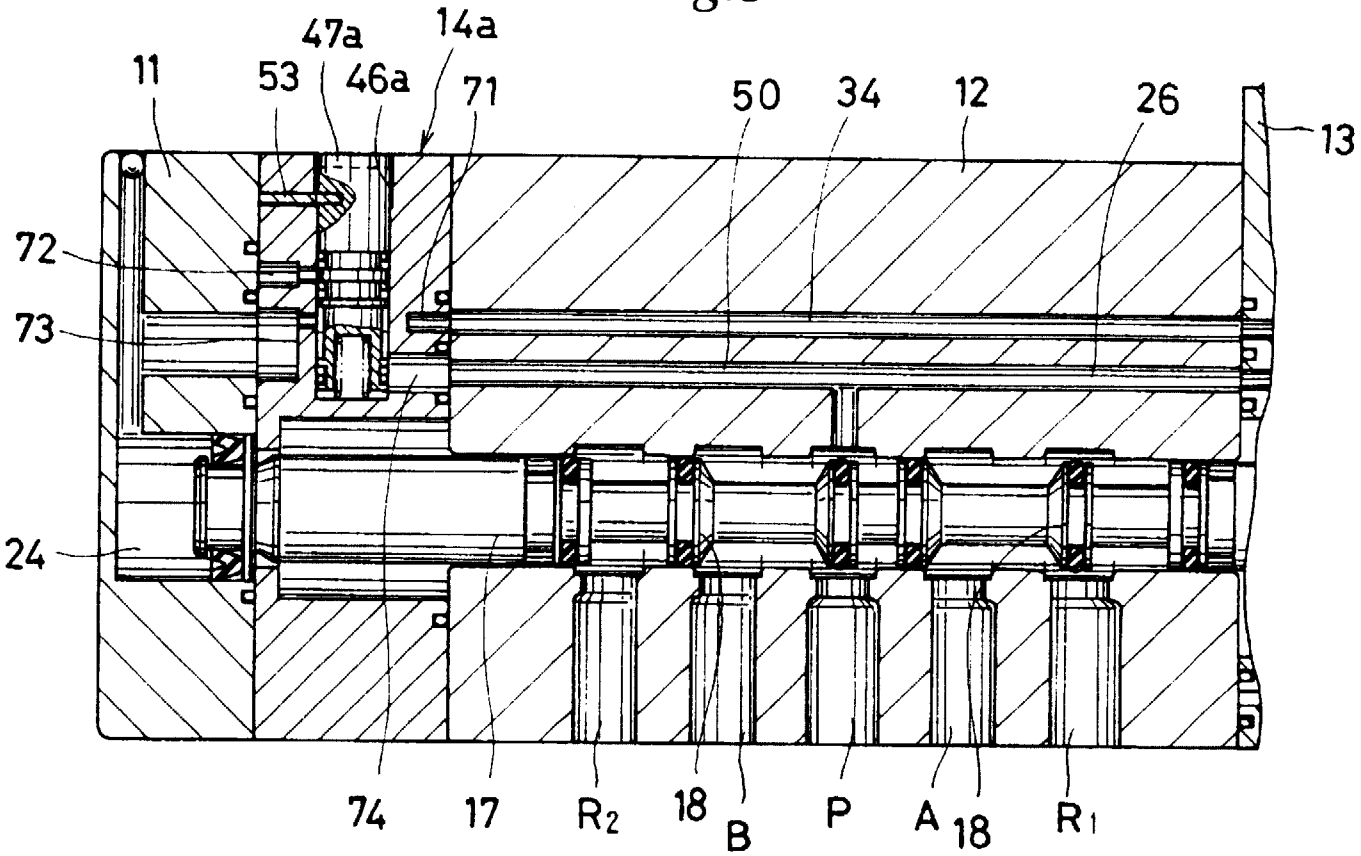
FIG. 5 is a sectional view showing the approximately half part of a solenoid controlled valve in accordance with the second embodiment.
Figure 6:
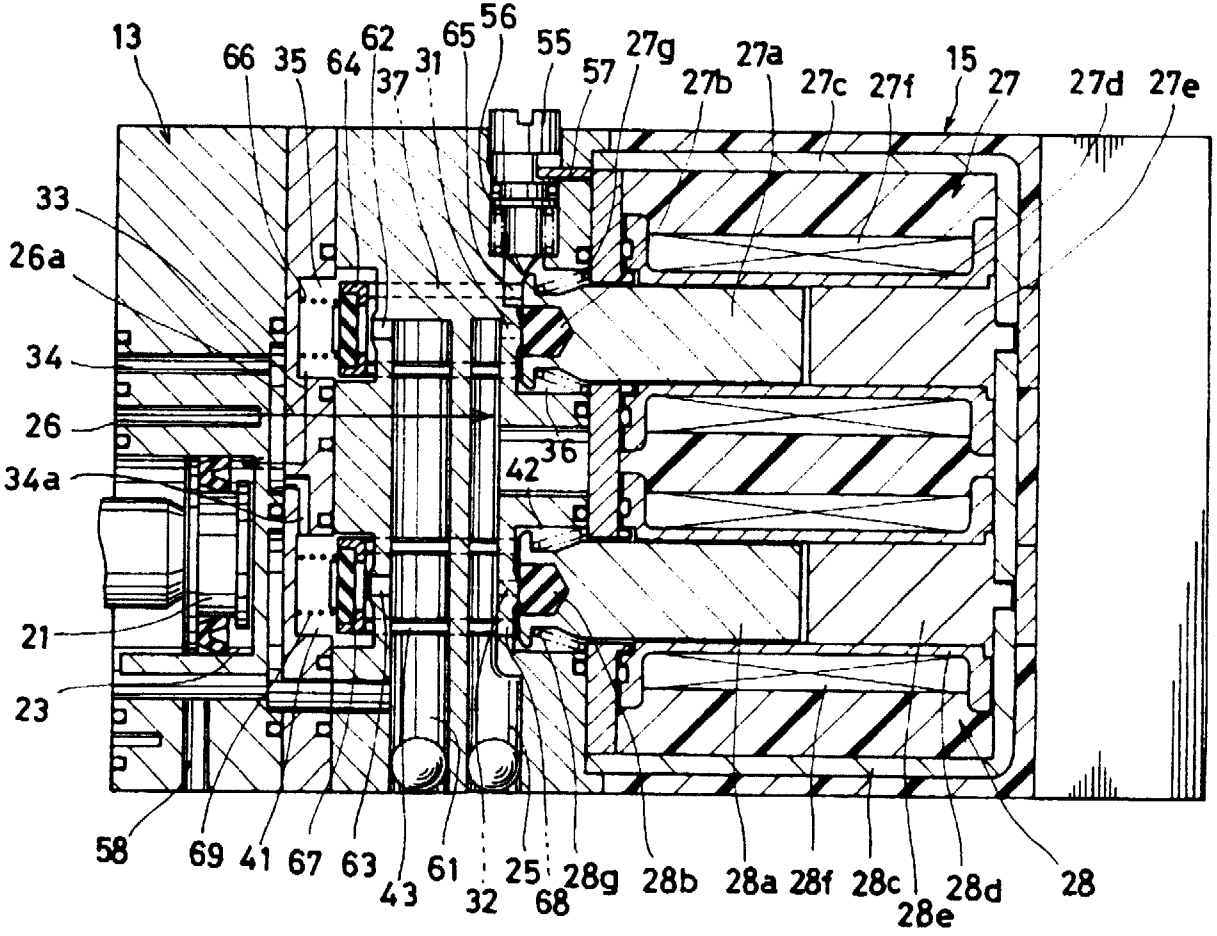
FIG. 6 is a sectional view showing the other part of the solenoid controlled valve which is set to a single solenoid type.
Figure 7:
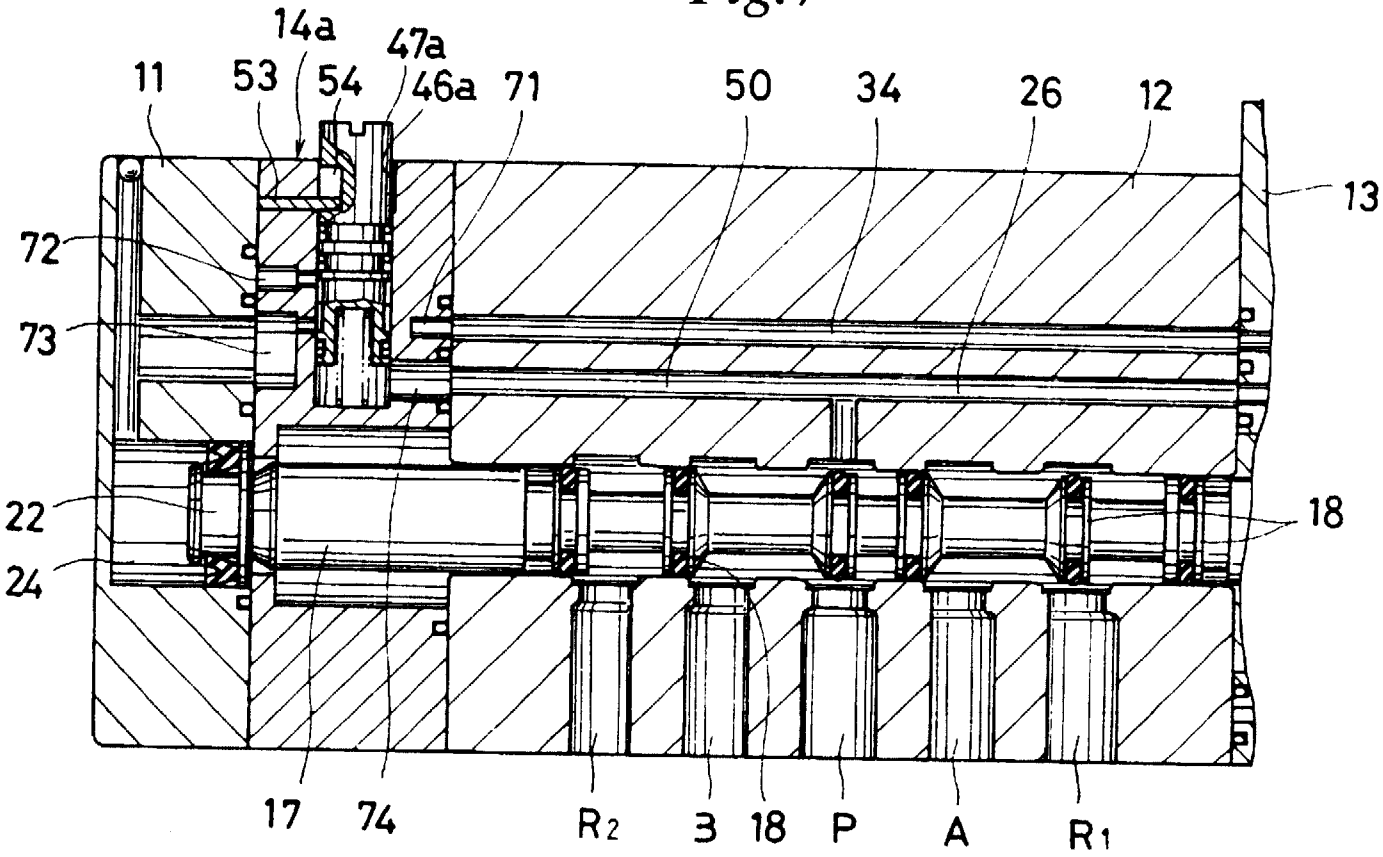
FIG. 7 is a sectional view showing the approximately half part of the solenoid controlled valve which is set to a double solenoid type.

FIG. 5–FIG. 7 are views showing a solenoid controlled valve in accordance with the second embodiment of the present invention, the parts and those of the first embodiment are affixed with the same number.

In this case, a converting portion **14*a* is provided between a pilot portion 11 and a main valve portion 12, an exhaust passage 61 is provided at the position corresponding to a spool shaft hole 46**. Except for these points, the solenoid controlled valve is generally the same construction as the solenoid controlled valve in accordance with the first embodiment.

An introducing port 62 communicating with the exhaust passage 61 and a fluid chamber 35 is provided at the center position of a first communicating port 31, an introducing passage 63 communicating with the exhaust passage 61 and a fluid chamber 41 is provided at the center position of a first communicating port 31.

An interlock pin 65 is passed through the communicating hole 37 between the plunger **27*a* and a valve member 64 integrated into the fluid chamber 35. A gap communicating with the fluid chamber 35 and the fluid chamber 36 is formed between the interlock pin 65 and the inside face of the communicating hole 37. Therefore, when the valve 27*b* of the first solenoid 27 is separated from the first communicating port 31, the introducing port 62 is blocked by the valve member 64 due to the press force of the spring 66**.

An interlock pin 68 is passed through the communicating port 43 between the plunger **28*a* and a valve member 67 integrated into the fluid chamber 41. A gap communicating with the fluid chamber 41 and the fluid chamber 42 is formed between the interlock pin 68 and the inside face of the communicating port 43. Therefore, when the 28*b* of the second solenoid 28 is separated from the second communicating port 32, the introducing passage 63 is blocked by the valve member 67 due to the press force of the spring 69**.

As with the solenoid controlled valve in accordance with the first embodiment, a charging port (P) is connected to a common communicating passage 25 by the communicating passage 26, a first operated passage 34 communicating with a large diameter pressure chamber 23 and the charging port (P) is opened and blocked by the first solenoid 27; a second operated passage 34 communicating with a small diameter pressure chamber 24 and the charging port (P) is opened and blocked by the second solenoid 28.

An introducing groove 71 formed at the converting portion **14*a* and an introducing groove 72 positioned on the opposite side therefrom are connected to each other by a fluid passage (not shown). An introducing groove 73 adjacent to the introducing groove 72 is connected to the small diameter pressure chamber 24. The introducing grooves 72,73 communicate with each other through a spool shaft hole 46***a*. A by-pass 74 opened to the spool shaft hole 46*a* is formed at the converting portion 14*a*, a by-pass 50 connected to the by-pass 74 and the charging port (P) is formed at a main valve portion 12 branching from a communicating passage 26.

In the spool shaft hole 46*a*, a convert-valve shaft (converting means) 47*a* is fitted slidably in the axial direction thereof, and is moved to the initial position as shown in FIG. 5 or the actuated position as shown in FIG. 7. The second operated passage 34 and the by-pass 50 communicate with the small diameter pressure chamber 24 through the convert-valve shaft 47*a* in parallel.

In the initial position as shown in FIG. 5, the introducing groove 73 and the by-pass 74 are in a communicating state through the convert-valve shaft 47*a*, so that the by-pass 50 and the small diameter pressure chamber 24 communicate with each other. Hence, in this state, the solenoid controlled valve is a single solenoid controlled valve ("return position type").

In the actuated position as shown in FIG. 7, the introducing groove 72 and the introducing groove 73 are in a communicating state through the convert-valve shaft 47*a*, so that the second operated passage 34 is in a state to communicate with the small diameter pressure chamber 24. A valve member 67 interlocking with a plunger 28*a* of a second solenoid. 28 is provided in a fluid chamber 41, so that the small diameter pressure chamber 24 is in a state to communicate with the exhaust passage 61 when the coil 28*f* of the second solenoid 28 is not energized. In this state, when the first solenoid 27 is actuated, the first operated passage 34 is opened and the introducing port 62 is blocked by the valve member 64, the fluid is therefore supplied into the large diameter pressure chamber 23.

On the other hand, when the second solenoid 28 is actuated, the introducing passage 63 is blocked by the valve member 67 interlocking with plunger 28*a*, the fluid from the charging port (P) is therefore supplied from the second operated passage 34 to the small diameter pressure chamber 24.

Since the solenoid controlled valve in accordance with the second embodiment is constructed-as above, it is possible to use one solenoid controlled valve as a single solenoid controlled valve ("return position type") or a double solenoid controlled valve ("hold position type") by operating the convert-valve shaft 47*a*.

(Third Embodiment)

Shown in FIG. 8–FIG. 12 are views showing a solenoid controlled valve in accordance with the third embodiment of the present invention.

Figure 1:
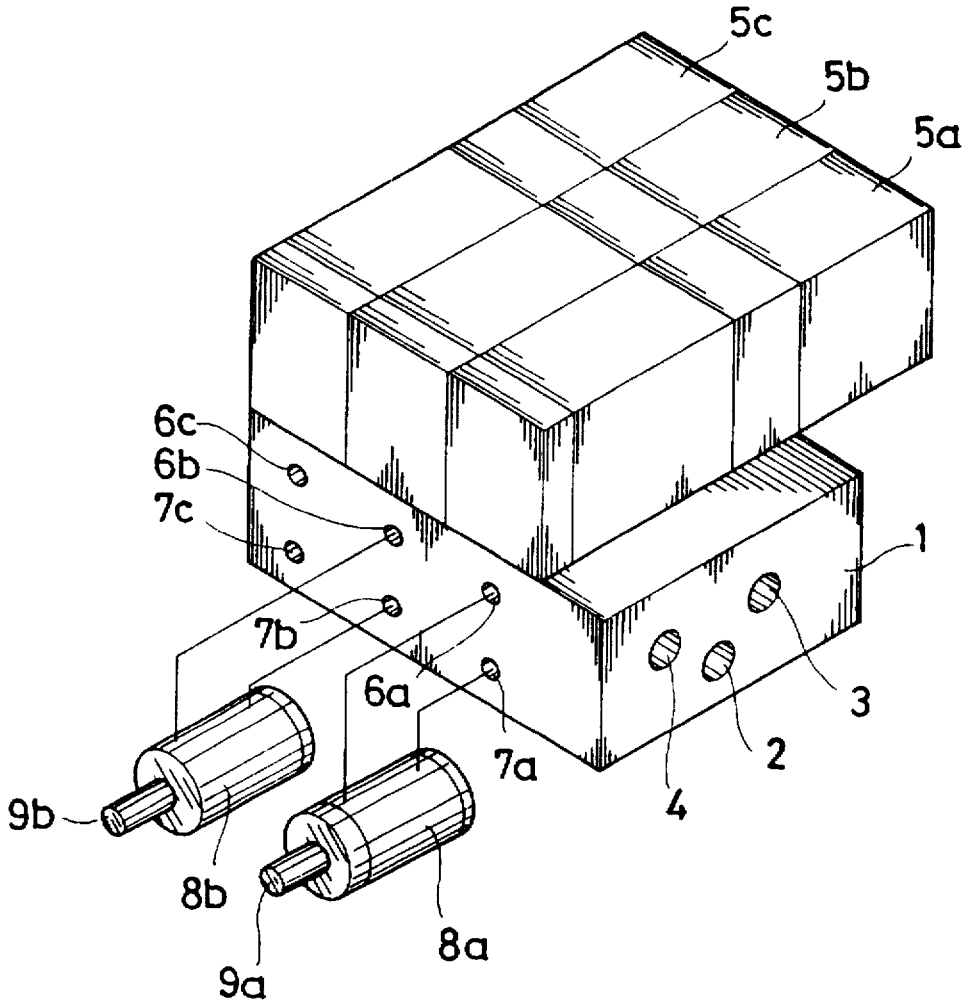
FIG. 1 is a perspective view showing a solenoid controlled valve in accordance with the first embodiment of the present invention.
Figure 8:
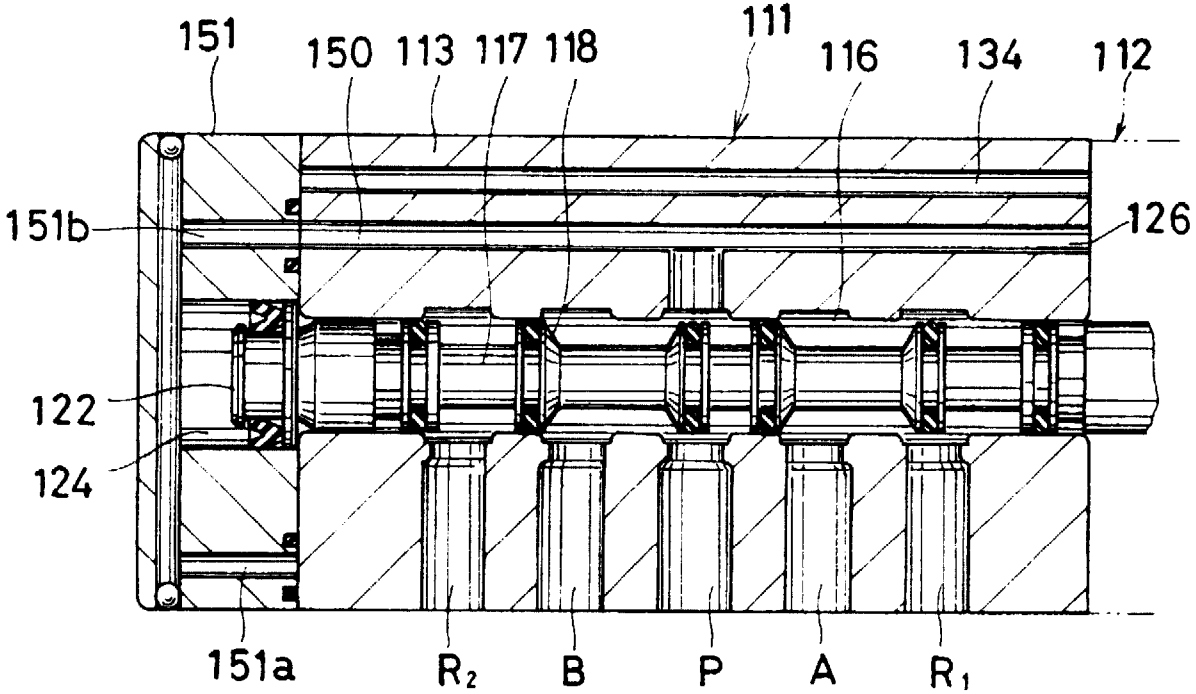
FIG. 8 is a sectional view showing the approximately half part of a solenoid controlled valve in accordance with the third embodiment, which is set to a single solenoid type.
Figure 9:
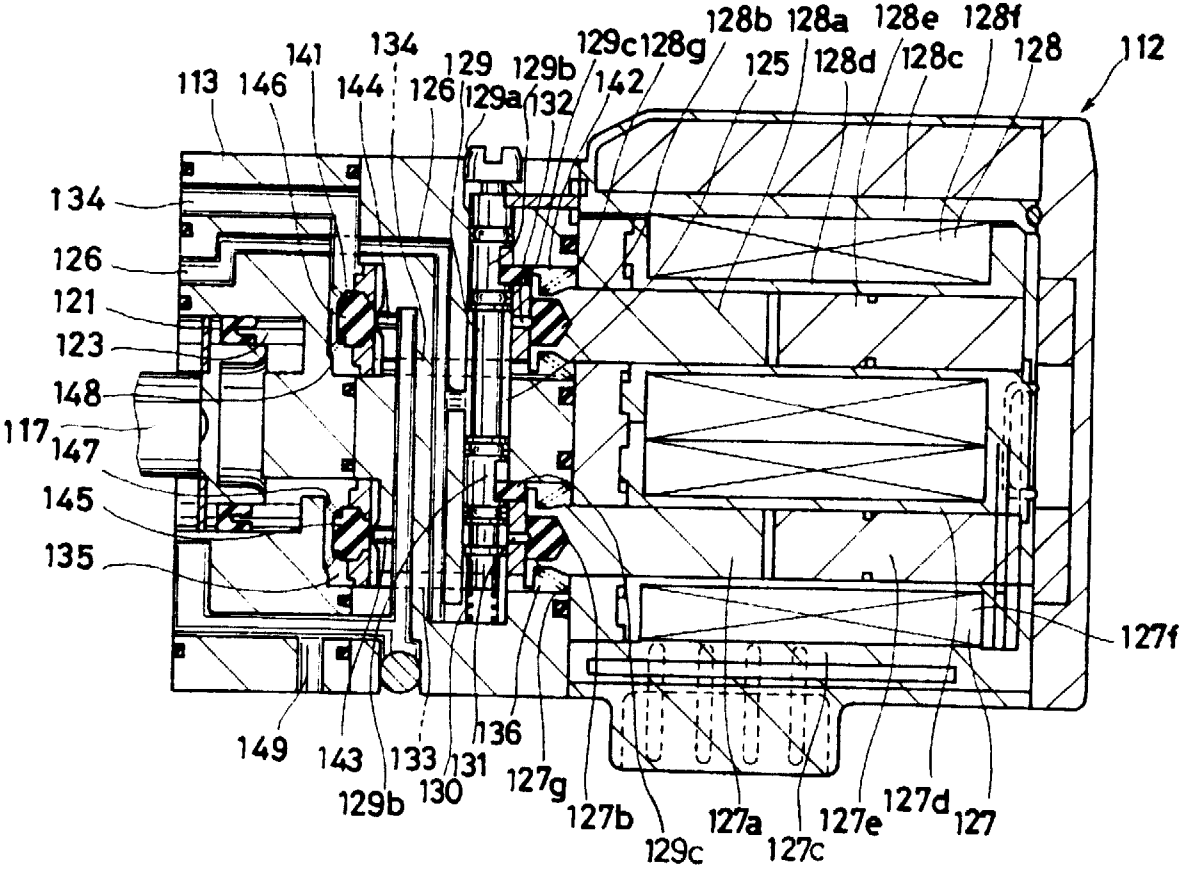
FIG. 9 is a sectional view showing the other part of the solenoid controlled valve shown in FIG. 8.

The solenoid controlled valve in accordance with the third embodiment is mounted on the manifold block 1 as shown in FIG. 1. As shown in FIG. 8 and FIG. 9, a main valve 111 and a solenoid 112 are unitarily constructed, so that a housing 113 is formed. The housing 113, at the lower portion thereof, is fixed on the manifold block not shown in the Figure.

A valve hole 116 is, as shown in FIG. 8, formed in the main valve 111. Further, a charging port (P) is formed at the center portion in the axial direction of the main valve 111 opening to the valve hole 116. Furthermore, an exhaust port ($R_1$) and an exhaust port ($R_2$) are formed at both end portions of the main valve 111 opening to the valve hole 116. The charging port (P) is made to communicate with the charging port 2 of the manifold block. The exhaust port ($R_1$) is made to communicate with the exhaust port 3, the exhaust port ($R_2$) is made to communicate with the exhaust port 4. An output port (A) is formed between the charging port (P) and the exhaust port ($R_1$), which is opened to the valve hole 116. An output port (B) is formed between the charging port (P) and the exhaust port ($R_2$), which is opened to the valve hole 116. The output port (A) communicates with, for example, the output ports 6*a* of the manifold block, the output port (B) communicates with, for example the output ports 7*a* of the manifold block.

A valve shaft 117 is fitted into the valve hole 116 slidably in the axial direction thereof, a valve 118 is attached on the valve shaft 117. Thus, as shown in FIG. 8, the valve shaft 117 is in a state to move to the right in FIG. 8, the charging port (P) and the output port (B) communicate with each other, the output port (A) and the exhaust port ($R_1$) communicate with each other. On the other hand, the valve shaft 117 is in the state to move to the left in FIG. 12, the charging port (P) and the output port (A) communicate with each other, the output port (B) and the exhaust port ($R_2$) communicate with each other.

A large diameter piston 121 is provided at one end, that is, the right end (left side in FIG. 9) of the valve shaft 117. A small diameter piston 122 is provided at the other end (right side in FIG. 8) of the valve shaft 117, the diameter of which is smaller than that of the large diameter piston 121. In the Figure, the pressed area of the large diameter piston 121 is predetermined to be twice the pressed area of the small diameter piston 122. The large diameter piston 121 is housed in a large diameter pressure chamber 123 which is formed in the solenoid 112; the small diameter piston 122 is housed in a small diameter pressure chamber 124 which is formed at the left side.

As shown in FIG. 9, a common communicating chamber 125 is formed at a solenoid 112, the common communicating chamber 125 communicates with the charging port (P) by a connecting passage 126. Hence, the fluid from the charging port (P) is ordinary supplied to the common communicating chamber 125. Further, a manual operation rod 129 is stored in the common communicating chamber 125. A plunger 127*a* of a first solenoid 127 and a plunger 128*a* of the second solenoid 128 are moved backward by the manual operation rod 129 by a manual operation. The manual operation rod 129 is inserted into the common communicating chamber 125 in the state in which an operating portion 129*a* formed at manual operation rod 129 is facing to the outside, and is energized toward the operating portion 129*a* by a spring member 130. Two cams 129*b*,129*b* are formed at manual operation rod 129. The position of the cam 129*b* is converted circumferentially by rotating the operating portion 129*a*, so that the plunger 128*a* is moved backward by a manual operation, through a pin 129*c*.

A first communicating port 131 formed at the common communicating chamber 125 communicates with the large diameter pressure chamber 123 through a first operation passage 133. The plunger 127*a* of the first solenoid 127 is arranged facing the first communicating port 131 so as to be able to open or block the first operation passage 133.

A second communicating port 132 formed at the common communicating chamber 125 communicates with the small diameter pressure chamber 124 through the second operation passage 134. The plunger 128*a* of the second solenoid 128 is arranged facing the second communicating port 132 so as to be able to open or block the second operation passage 134.

A valve 127b for press fitting to the first communicating port 131 is provided at the top end portion of a plunger 127a of the first solenoid 127, the plunger 127a is attached in a bobbin 127d fitted to a yoke 127c, movably in the axial direction thereof. A fixed core 127e is fixed at the back end portion of a bobbin 127d, a solenoid is formed by winding a coil 127f around the outside of the bobbin 127d.

A plunger 127a is energized by a pressed coil spring 127g so that the valve 127b might be press fitted to the first communicating port 131. When the coil 127f is energized, the plunger 127a is separated from the first communicating port 131 in resistance to the press force.

The second solenoid 128 adjacent to the first solenoid 127 is provided so as to parallel thereto, which is the same construction as the first solenoid 127. The constituting members of the second solenoid 128 are affixed the symbols "a"–"g" as are the constituting members of the first solenoid 127.

A fluid chamber 135 is formed at the solenoid 112 on the prolongation line of the plunger 127a, which communicates with a fluid chamber 136 by a first operation passage 133, the fluid chamber 136 is formed at the outside of the top end portion of the plunger 127a. Thus, when the coil 127f is energized, the valve 127b is separated from the first communicating port 131, then, the fluid in the common communicating chamber 125 is supplied into the large diameter pressure chamber 123 through the fluid chamber 136, the first operation passage 133 and the fluid chamber 135.

A fluid chamber 141 is formed on the prolongation line of the plunger 128a, which communicates with a fluid chamber 142 by a second-operation passage 134. The fluid chamber 142 is formed at the outside of the top end portion of the plunger 128a. Thus, when the coil 128f is energized, the valve 128b is separated from the second communicating port 132, then, the fluid in the common communicating chamber 125 is supplied to the small diameter pressure chamber 124 through the fluid chamber 142, the second operation passage 134 and the fluid chamber 141.

Valves 145,146 for opening and blocking exhaust ports 143,144 are respectively provided in the fluid chambers 135,141. The valves 145,146 are respectively energized by pressed coil springs 147,148 in the direction of the closed positions of the exhaust ports 143,144 communicating with an exhaust opening 149. The valve 145 touches one end of an opening-closing pin (not shown) which is provided in the first operation passage 133, the other end of the opening-closing pin is touched to the plunger 127a. The valve 146 touches one end of the other opening-blocking pin (not shown) which is provided in the second operation passage 134, the other end of the other opening-blocking pin touches the plunger 128a. Thereby, each valve 145,146 is moved corresponding to the movement of the forward or backward of each plunger 127a,128a.

Accordingly, when each first communicating port 131, 132 is released by the movement of the backward of each plunger 127a,128a, each exhaust port 143,144 is blocked by each valve 145,146, by each opening-blocking pin, and the fluid from the common communicating chamber 125 is supplied to the large diameter pressure chamber 123 or the small diameter pressure chamber 124. On the other hand, when each plunger 127a,128a is moved forward, each valve 145,146 pushed by each opening-blocking pin is made to move to the direction in resistance to the spring force of each pressed coil spring 147,148. Thereby each exhaust port 143,144 is released, and the fluid in the large diameter pressure chamber 123 or the small diameter pressure chamber 124 is discharged from the exhaust opening 149.

Figure 10:
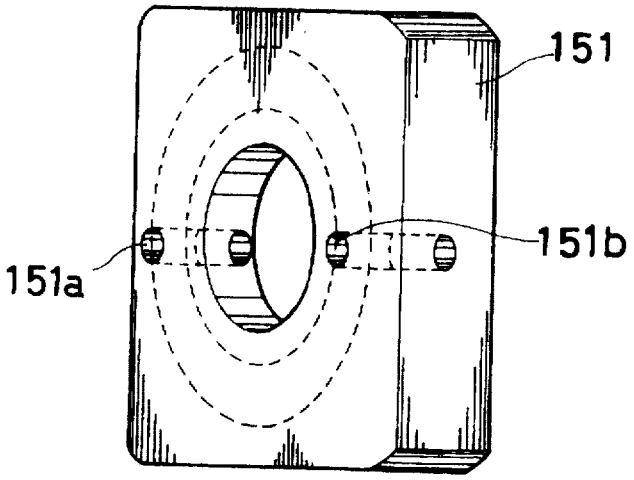
FIG. 10 is a perspective view showing the inside of a fluid passage changing block employed to the solenoid controlled valve.

As described above, the charging port (P) is made in communicate with the connecting passage 126, as shown in FIG. 8, and also communicate with a by-pass 150 which may be connected to the small diameter pressure chamber 124. A fluid passage changing block (converting means) 151 is removably provided at the small diameter piston 122 side of the housing by a bolt(s) (not shown). A communicating hole 151a corresponding to the second operation passage 134 and a by-pass communicating hole 151b corresponding to the by-pass 150 are opened at the fluid passage changing block 151. Hence, the second operation passage 134 and the by-pass 150 communicate with the small diameter pressure chamber 124 through the communicating hole 151a and the by-pass communicating hole 151b opened at the fluid passage changing block 151. As shown in FIG. 10, the communicating hole 151a and the by-pass communicating hole 151b opened at the fluid passage changing block 151 are respectively formed on a concentric circles, the center of which is the rotating axis of the fluid passage changing block 151; and are the on the opposite side (shifted to 180°) in the diametrical direction of the fluid passage changing block 151.

Figure 11:
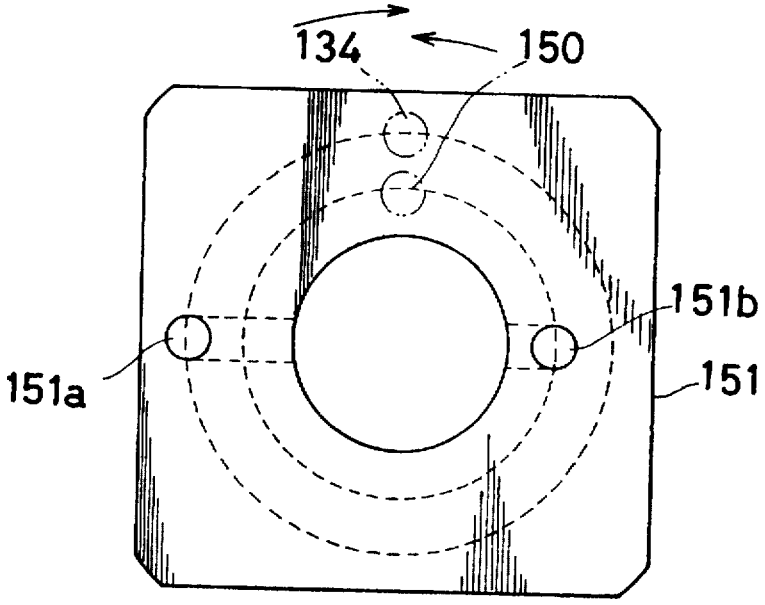
FIG. 11 is a descriptional view showing the relative position of the fluid passage changing block, a second operated passage and a by-pass.
Figure 12:
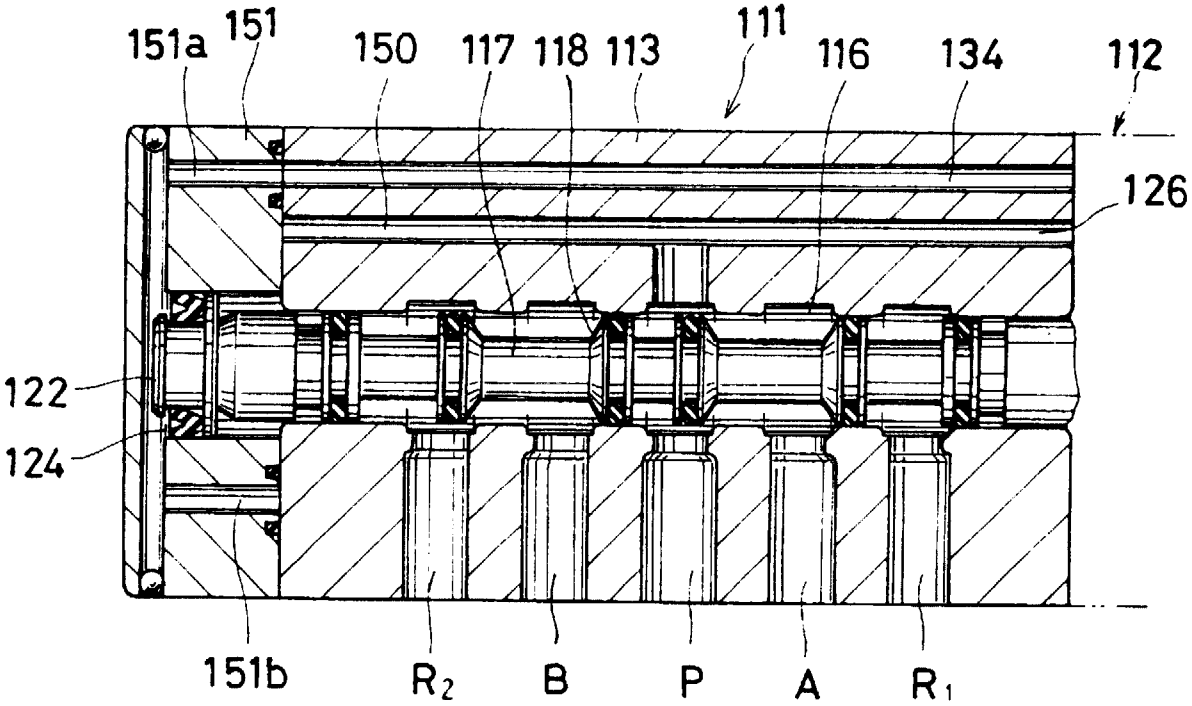
FIG. 12 is a sectional view showing the solenoid controlled valve which is set to a double solenoid type.

As shown in FIG. 11, the by-pass communicating hole 151b is made to correspond to the by-pass 150 by the rotating the fluid passage changing block 151, so that the by-pass 150 and the small diameter pressure chamber 124 communicate with each other, the fluid passage changing block 151 is therefore set at the initial position. As shown in FIG. 12, the second operation passage 134 and the small diameter pressure chamber 124 communicate with each other by the correspondence of the communicating hole 151a to second operation passage 134, the fluid passage changing block 151 is hold at the actuated position. In this way, the fluid passage changing block 151 can communicate with the small diameter pressure chamber 124 by the second operation passage 134 or by-pass 150.

When the fluid passage changing block 151 is set to the initial position as shown in FIG. 8, the fluid of the charging port (P) is ordinarily supplied to the small diameter pressure chamber 124, through the by-pass 150. Accordingly, in this state, when the coil 127f of the first solenoid 127 is energized, the valve shaft 117 is moved to the left in FIG. 8; when the energizing of the coil 127f of the first solenoid 127 is stopped, the valve shaft 117 is returned to the position before the coil 127f of the first solenoid 127 was energized. On the other hand, the fluid passage changing block 151 is set to the actuated position shown in FIG. 12, when the first operation passage 133 is opened when the coil 127f of the first solenoid 127 is energized, thereby the fluid is supplied to the large diameter pressure chamber 123, so that the valve shaft 117 is moved to the left as shown in FIG. 12. When the coil 128f of the second solenoid 128 is energized, the fluid is supplied to the small diameter pressure chamber 124 by releasing the second operation passage 134, so that the valve shaft 117 is moved to the right in FIG. 12. The valve shaft 117 holds the position determined at that time when the energizing of the first solenoids 127,128 is stopped.

Next, the actuation of the solenoid controlled valve as in the above is described. FIG. 8 is a view showing the solenoid controlled valve employed as a single solenoid type. The coil 28f of the second solenoid 28 as shown in FIG. 9 is not energized, which is predetermined to be in a stopped state. The fluid passage changing block 151 is set to the initial position shown in FIG. 8, in which the by-pass 150 communicates with the small diameter pressure chamber 124 through the by-pass communicating hole 151b. In this case, the fluid from the charging port (P) is supplied from the by-pass 150 into the small diameter pressure chamber 124 through the by-pass communicating hole 151*b*. Hence, in the state in which the coil 127*f* of the first solenoid 127 is not energized, the valve shaft 117 is at the position shown in FIG. 8 due to the fluid pressure supplied to the small diameter pressure chamber 124, and the fluid of the charging port (P) flows out to the output port (B).

On the other hand, when the coil 127*f* of the first solenoid 127 is energized, the valve 127*b* separates from the first communicating port 131, the common communicating chamber 125 and the fluid chambers 135,136 are in a communicating state. Thus, the fluid flows out to the large diameter pressure chamber 123 from the charging port (P) through first operation passage 133. The pressed area of the large diameter piston 121 is predetermined to be twice as large as that of the small diameter piston 122, so that even when the fluid is supplied to the small diameter pressure chamber 124, the valve shaft 117 is moved to the left in FIG. 8 by the fluid supplied to the large diameter pressure chamber 123. Hereby, the fluid of the charging port (P) flows to the output port (A), and the fluid from the output port (B) flows to the exhaust port ($R_2$).

Next, in the case in which the solenoid controlled valve is employed as a double solenoid type, the fluid passage changing block 151 is set to the actuated position shown in FIG. 12 by rotating the fluid passage changing block 151, the coil 128*f* of the second solenoid 128 is predetermined to be in a state in which electricity can be supplied thereto.

Hereby, the fluid is supplied from the second operation passage 134 to the small diameter pressure chamber 124, the valve shaft 117 is moved to the right from the position shown in FIG. 12. On the other hand, when the coil 127*f* of the first solenoid 127 is energized by stopping the energizing to the coil 128*f* of the second solenoid plunger 27*a* the fluid is supplied to the large diameter pressure chamber 123, and the valve shaft 117 is moved to the position shown in FIG. 12. In this case, when stopping the energizing of the coil 128*f*, the valve shaft 117 is held in position at that time.

Since the solenoid controlled valve in accordance with the third embodiment is constructed as above, it is possible to use one solenoid controlled valve as a single solenoid controlled valve (a "return position type") or a double solenoid controlled valve (a "hold position type") by changing the position of the fluid passage changing block 151 to the initial position or the actuated position.

(Fourth Embodiment)

Figure 13:
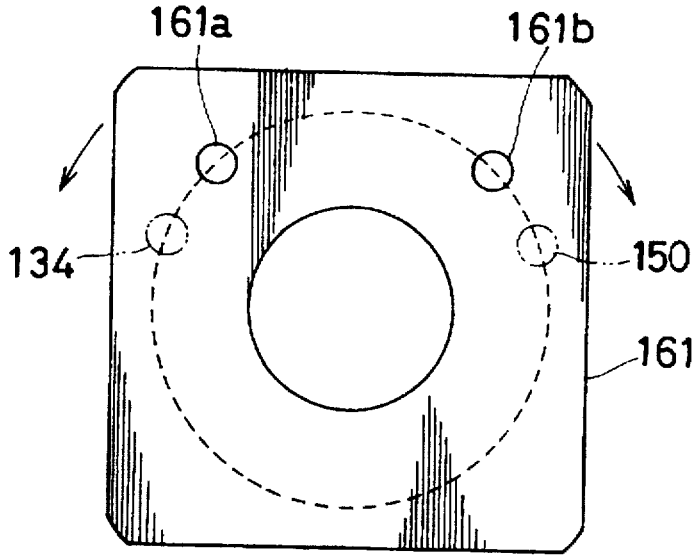
FIG. 13 is a descriptional view showing the relative position of the fluid passage changing block, the second operated passage and the by-pass, which are employed to a solenoid controlled valve in accordance with the fourth embodiment.

FIG. 13 is descriptional view showing the relative positions of the fluid passage changing block, the second operated passage and the by-pass in accordance with the fourth embodiment.

As shown in FIG. 13, in a fluid passage changing block (converting means) 161 in accordance with the fourth embodiment, a communicating hole 161*a* for the second operated passage 134, and a by-pass communicating hole 161*b* are formed on a circle, the center of which is the axis of the valve shaft 117 shown in FIG. 12. The communicating hole 161*a* communicates between the second operation passage 134 and the small diameter pressure chamber 124 shown in FIG. 12; the by-pass communicating hole 161*b* communicates between the small diameter pressure chamber 124 and the by-pass 150. Further, the communicating hole 161*a* and the by-pass communicating hole 161*b* are formed so as to communicate with the second operation passage 134 and the by-pass 150 simultaneously. Hence, the second operation passage 134 or the by-pass 150 communicates with the small diameter pressure chamber 124 through the communicating hole 161*a* or the by-pass communicating hole 161*b* by rotating the fluid passage changing block 161.

In this way, the communicating hole 161*a* and the by-pass communicating hole 161*b* opened at the fluid passage changing block 161 are also formed on the circle.

(Fifth Embodiment)

Figure 14:
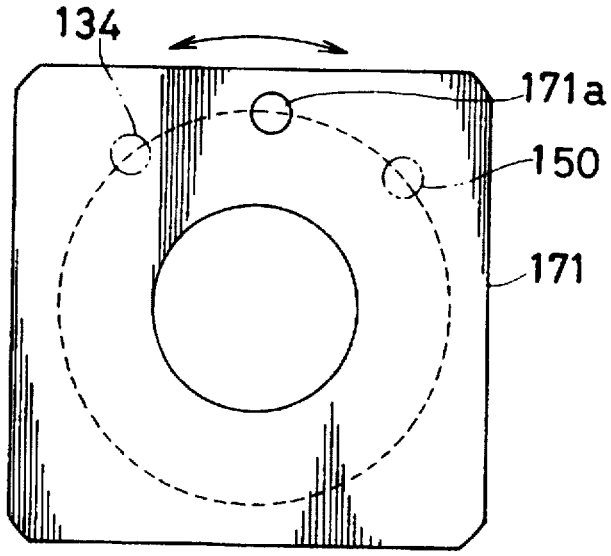
FIG. 14 is a descriptional view showing the relative position of the fluid passage changing block, the second operated passage and the by-pass, which are employed to a solenoid controlled valve in accordance with the fifth embodiment.

FIG. 14 is descriptional view showing the relative positions of the fluid passage changing block, the second operated passage and the by-pass in accordance with the fifth embodiment.

As shown in FIG. 14, a communicating hole 171*a* for the second operated passage 134 is opened at a passage converting block (converting means) 171, which makes the second operation passage 134 or the by-pass 150 communicate with the small diameter pressure chamber 124. The opening of the second operation passage 134 or by-pass 150 corresponds to the communicating hole 171*a* by rotating the passage converting block 171, hereby one of them communicates with the small diameter pressure chamber 124.

In this way, an opening, as the communicating hole 171*a* for the second operated passage 134, is also opened at the passage converting block 171, and can communicate with the second operation passage 134 or the by-pass 150.

The present invention is not limited to this embodiment; in so far as the essence of the invention is not deviated from, it goes without saying that the present invention can be modified.

The number of ports is five in the above embodiments, but it is also possible to employ, for instance, four or three, or more than six ports.

What is claimed is:

1. A solenoid controlled valve including a housing having a valve hole, an intake port opening into said valve hole, and output and exhaust ports communicating with said intake port through said valve hole;

a valve shaft, fitted in said valve hole and slideable in the axial direction thereof, said valve shaft having a large diameter piston at one end portion and a small diameter piston at the opposite end portion thereof, said valve shaft having a plurality of valves;

the solenoid controlled valve comprising:

a plurality of solenoids including;

a first solenoid for controlling communication between a common communicating passage formed in said housing and a first-operating passage communicating with a large diameter pressure chamber in said housing and containing said large diameter piston;

and a second solenoid for controlling communication between said common communicating passage and a second operating passage communicating with a small diameter pressure chamber in said housing containing said small diameter piston;

said housing having a by-pass including a spool shaft hole communicating between said intake port and said small diameter pressure chamber by communicating said second operating passage with said intake port, said by-pass being out of relation to the operation of said second solenoid;

converting means for altering operating characteristics of said solenoid controlled valve in response to operation of said solenoids and movable between an initial position and an actuated position, said converting means formed to be fixable at both said initial position and said actuated position;

when said converting means is in said actuated position said by-pass is blocked to communicate said intake port with said small diameter pressure chamber when said second solenoid is energized; whereby, when said converting means is in said initial position fluid is supplied to said large diameter pressure chamber by energizing said first solenoid to actuate said valve shaft, and when the energizing of said first solenoid is stopped fluid is supplied to said small diameter pressure chamber via said by-pass;

and when said converting means is in said actuated position, fluid is supplied to said small diameter pressure chamber by energizing said second solenoid and to said large diameter pressure chamber by energizing said fine solenoid to actuate said valve shaft, and when the energizing of said first and second solenoids is stopped, said valve shaft is held at the position in which said valve shaft existed when said solenoids were energized.

2. A solenoid controlled valve including a housing having a valve hole, an intake port opening into said valve hole, and output and exhaust ports communicating with said intake port through said valve hole;

a valve shaft, fitted in said valve hole and slideable in the axial direction thereof, said valve shaft having a large diameter piston at one end portion and a small diameter piston at the opposite end portion thereof, said valve shaft having a plurality of valves;

the solenoid controlled valve comprising:

a plurality of solenoids including;

a first solenoid for controlling communication between a common communicating passage formed in said housing and a first operating passage communicating with a large diameter pressure chamber in said housing and containing said large diameter piston;

and a second solenoid for controlling communication between said common communicating passage and a second operating passage communicating with a small diameter pressure chamber in said housing containing said small diameter piston;

said housing having a by-pass, communicating between said intake port and said small diameter pressure chamber and including a spool shaft hole formed in said housing to communicate with said second operating passage and said small diameter pressure chamber, said by-pass being out of relation to the operation of said second solenoid;

converting means for altering operating characteristics of said solenoid controlled valve in response to operation of said solenoids and including a convert-valve slideably fitted in said spool shaft hole and movable between an initial position and an actuated position, said convert-valve formed to be fixable in both said initial position and said actuated position;

when said converting means is in said actuated position said by pass is blocked to communicate said intake port with said small diameter pressure chamber when said second solenoid is energized; whereby, when said converting means is in said initial position fluid is supplied to said large diameter pressure chamber by energizing said first solenoid to actuate said valve shaft, and when the energizing to said first solenoid is stopped fluid is supplied to said small diameter pressure chamber via said by-pass;

and when said converting means is in said actuated position, fluid is supplied to said small diameter pressure chamber by energizing said second solenoid and to said large diameter pressure chamber by energizing said first solenoid to actuate said valve shaft, and when the energizing of said first and second solenoids is stopped, said valve shaft is held at the position in which said valve shaft existed when said solenoids were energized.

* * * * *